US011878210B1

(12) United States Patent
Torres

(10) Patent No.: US 11,878,210 B1
(45) Date of Patent: Jan. 23, 2024

(54) SHOULDER SUPPORTED APPARATUS FOR TONING AND STRENGTHENING THE NECK, CHIN AND FACE

(71) Applicant: Alfonso Javier Torres, Fresno, CA (US)

(72) Inventor: Alfonso Javier Torres, Fresno, CA (US)

( * ) Notice: Subject to any disclaimer, the term of this patent is extended or adjusted under 35 U.S.C. 154(b) by 76 days.

(21) Appl. No.: 17/578,430

(22) Filed: Jan. 18, 2022

Related U.S. Application Data

(60) Provisional application No. 63/137,904, filed on Jan. 15, 2021.

(51) Int. Cl.
*A63B 23/025* (2006.01)
*A63B 21/055* (2006.01)
(Continued)

(52) U.S. Cl.
CPC ..... *A63B 23/025* (2013.01); *A63B 21/00069* (2013.01); *A63B 21/0414* (2013.01);
(Continued)

(58) Field of Classification Search
CPC . A63B 23/025; A63B 21/0552; A63B 21/065; A63B 21/4005; A63B 23/03; A63B 21/00189; A63B 21/00058; A63B 21/0407; A63B 21/04; A63B 21/0414; A63B 21/0557; A63B 21/00069; A63B 21/00043; A63B 21/4001; A63B 21/4023; A63B 21/00185; A63B 21/055; A63B 21/16; A63B 21/4039; A61H 1/00; A61H 1/02; A61H 1/0296; A61H 1/0292; A61H 2201/0157; A61H 2205/04; A61H 2201/1253; A61H 2203/0487; A61H 2201/1261; A61H 2201/1269
See application file for complete search history.

(56) References Cited

U.S. PATENT DOCUMENTS 2,551,727 A * 5/1951 Costello ..... A61G 7/072 5/643
2,634,435 A * 4/1953 Budd ..... A47G 9/1054 5/643
(Continued)

FOREIGN PATENT DOCUMENTS

JP 2011110095 A * 6/2011

*Primary Examiner* — Megan Anderson
(74) *Attorney, Agent, or Firm* — Richard A. Ryan

(57) ABSTRACT

An apparatus for toning and strengthening the muscles of the neck, chin and face that is supported on one or more of the user's shoulders during use of the apparatus. The apparatus has a frame with frame members that define a shoulder supporting section configured to position an elastomeric sheet adjacent the user's head during use of the apparatus. The frame members also define a sheet support section that holds the elastomeric sheet on the frame. A positioning guide associated with the frame helps position the apparatus on the user. An adjusting mechanism allows the user to rotate the elastomeric sheet to increase or decrease its tension to increase or decrease the resistance from the user pressing his or her head against the elastomeric sheet. A locking mechanism prevents unwanted rotation of the elastomeric sheet. Clamps or other mechanisms removably attach the elastomeric sheet to the frame.

20 Claims, 6 Drawing Sheets

(51) Int. Cl.
*A63B 21/04* (2006.01)
*A63B 21/00* (2006.01)
*A63B 21/16* (2006.01)

(52) U.S. Cl.
CPC ..... *A63B 21/055* (2013.01); *A63B 21/16* (2013.01); *A63B 21/4039* (2015.10)

(56) References Cited

U.S. PATENT DOCUMENTS

| | | | | |
|---|---|---|---|---|
| 6,221,036 | B1 * | 4/2001 | Lucas | A61G 7/075 602/5 |
| 6,694,551 | B1 * | 2/2004 | Garrido | A47C 20/026 5/643 |
| 10,881,900 | B2 * | 1/2021 | Brask | A63B 21/4045 |
| 11,202,522 | B2 * | 12/2021 | Sakamoto | A47C 7/383 |
| 2016/0184627 | A1 * | 6/2016 | Sherborne | A63B 21/00069 482/10 |
| 2019/0143170 | A1 * | 5/2019 | Moss | A63B 23/0405 482/121 |

* cited by examiner

SHOULDER SUPPORTED APPARATUS FOR TONING AND STRENGTHENING THE NECK, CHIN AND FACE

CROSS-REFERENCE TO RELATED APPLICATIONS

This patent application claims priority to U.S. Provisional Patent Application Ser. No. 63/137,904 filed Jan. 15, 2021.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses for exercising and/or conditioning parts of the human body. In particular, the present invention relates to hand-held, non-powered apparatuses that are beneficially utilized to improve one or more specific parts of the user's body. Even more particularly, the present invention relates to such apparatuses that are specifically configured to exercise the user's neck, chin and face so as to tone and strengthen these parts of his or her body.

B. Background

Many people utilize exercise equipment to improve their health and fitness levels, to control or lose weight and as a method to tone and strengthen parts of their body. To assist with improving health, fitness and/or weight loss, many people walk, run, bike, kayak or engage in similar motion or sports activities and/or they utilize specially configured exercise equipment, such as weight benches, treadmills, elliptical machines, stair climbers and the like, that allow the user to effectively and efficiently target the area or areas of their body they wish to strengthen and to allow the user to improve his or her cardio and lung operation. Many of the above exercises are generally done in outdoor areas, home gyms and/or fitness centers where there is the sufficient space, area and/or equipment to accomplish the exercise objectives. People also commonly utilize hand-operated equipment, such as hand weights, resistance bands, jump ropes and the like, to target specific areas of their body to improve their health and fitness and/or to control or lose weight.

As well known, to assist with improving fitness and/or losing weight, as well as to tone and strengthen their body, many people utilize specially configured exercise equipment that allows the user to more effectively and efficiently target a specific area of their body they wish to improve. For instance, there are numerous types of exercise equipment that are configured to exercise a person's core area, which is generally considered the area near his or her abdomen and lower back. In addition, there is also specialized exercise equipment that is utilized to target a person's arms, shoulders, wrists, fingers, legs and/or gluteal muscles. In the field of exercise equipment and exercise methods, the use of specifically configured exercise equipment to improve the effectiveness and efficiency of various exercise and fitness routines to tone and strengthen areas of the human body are generally very well known.

One area of a person's body that is often neglected when it comes to toning and strengthening exercises is the person's neck, chin and face. With regard to the neck, the muscles of the neck of the human body are very complex, such that the movement of a person's head with respect to his or her body requires an integrated movement of many muscles in coordination with the articulation of his or her spine. Unfortunately, many people suffer from conditions resulting from improper orientation of the cervical spine and imbalance of the cervical muscles at or near the neck. These conditions may result from faulty or sustained postures, trauma from injury, emotional stress (muscle tension), arthritis and the like and result in problems such as localized pain, headaches, decreased circulation and soreness, to name a few, all of which are likely to decrease the quality of life of a person who is suffering from these conditions. In addition, as generally well known to persons who either suffer from or treat neck problems, such conditions have an associated cycle of pain and muscle contraction that can, ultimately, lead to decreased function and potential soft tissue dysfunction of the muscles around the neck.

Perhaps the most common way to attempt to alleviate pain around the neck is with medication and/or braces or other mechanical devices. However, well justified concerns about the side effects of the medications and the inconvenience of wearing a cumbersome device during the day and/or night generally limits the desirability of the use of such medication or mechanical devices. In addition, many existing medications and mechanical devices are symptomatic, in that while they may temporarily alleviate pain, they tend to only mask the signs and symptoms of the underlying condition, and therefore are not categorized as curative treatments. A way to alleviate pain in the neck area that is more curative is by strengthening and stretching the muscles in or around the head, neck, and shoulders. Free weights, dumbbells, and exercise/weight machines are utilized for building and training various muscles in the body, including the shoulders. The need for exercising the neck, both for therapeutic and strengthening purposes, has long been recognized, and various apparatuses and procedures are known in the prior art for addressing one or both of these issues. Despite the availability of such apparatuses and procedures, strengthening apparatuses for strengthening the core muscles of the neck are generally not widely utilized by or considered beneficial by persons having neck and related problems.

In addition to exercising the muscles for improved strength, there is also a recognized need and desire to exercise the muscles to improve muscle tone. Muscle atrophy and degeneration, which is a relatively common age related phenomena, results in muscle weakness and decreased muscle tone. As is well known, regular exercise is important to prevent muscle decline that leads to loss of muscle function. Stretching exercises are known to stimulate the muscles, thereby increasing the resilience and strength of the muscles and restoring physiological muscle tone to the neck, chin and face of the user. In addition to improving the strength of the person's neck area and improving his or her overall health, certain of these exercises are intended to improve the person's physical appearance by reducing sagging and the onset of wrinkles around the user's neck, chin and face that may be contributed to by muscle weakness in these areas.

As set forth above, a variety of apparatuses for exercising the neck, chin and face of a user are found in the prior art. Despite the availability of such apparatuses, many people do not take advantage of or otherwise utilize these apparatuses. In part, such lack of use may be due, at least in part, to the difficulty in using the apparatus, the cost of purchasing the apparatus, the need to have sufficient space and/or electrical power to operate the apparatus and the like. What is needed, therefore, is an improved apparatus for toning and strengthening a person's neck, chin and face areas. The new apparatus should be configured to strengthen the muscles around the neck, chin and face to improve muscle tone and to reduce pain in these areas of his or her body. In addition, the new apparatus should be easy and convenient to use and not require a specialized or dedicated area or the need for electrical or other power in order for a person to utilize the apparatus. The new apparatus should be safe to use, not require any specialized knowledge or training to benefit from such use and relatively compact and portable so the user may utilize the apparatus at any convenient location and to travel with the apparatus. In addition, it is preferred that the new apparatus be relatively inexpensive to manufacture so that it may be widely utilized.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as "including", "comprising" or "having" and variations thereof herein is meant to encompass the items listed thereafter and equivalents thereof. The terms "a" and "an" herein do not denote a limitation of quantity, but rather denote the presence of at least one of the referenced items. Further, the use of terms "first", "second", and "third", and the like, herein do not denote any order, quantity, or importance, but rather are used to distinguish one element or feature of an element from another. The term "and/or," when used herein with a list of two or more items, means that any one of the listed items can be employed by itself, or any combination of two or more of the listed items can be employed.

The new apparatus for toning and strengthening the muscles of the neck, chin and face of the present invention provides the benefits and solves the problems identified above. That is to say, the present invention is directed to an apparatus that is structured and arranged to help a person exercise the muscles in and around his or her neck, chin and face to tone and strengthen these areas of his or her body. As is set forth in more detail below, the new apparatus of the present invention is structured and arranged to exercise the muscles around the neck, chin and face to improve muscle tone and strength of these areas, which is likely to improve his or her appearance and reduce pain in these areas of his or her body that is at least partially associated with having weak muscle strength. In the preferred configurations of the present invention, the new apparatus is easy to use, does not require any specialized knowledge or training to benefit from such use, is convenient in that it can be used almost anywhere (e.g., it does not require any type of specialized or dedicated area) and does not need electrical or other power sources in order be utilized. The preferred configuration of the new toning and strengthening apparatus is safe to use and is relatively lightweight, compact and portable, which will allow the user to utilize the apparatus at any location that is convenient to him or her and to travel with the apparatus. In addition, the preferred configurations of the new apparatus are relatively inexpensive to manufacture, which will allow the apparatus to be widely utilized.

In one embodiment of the present invention, the new toning and strengthening apparatus generally comprises an elastomeric sheet that is attached to and supported by a frame so the apparatus can be used to exercise the muscles of a user's neck, chin and face. The elastomeric sheet has a first end, a second end, a first side and a second side. The materials for the elastomeric sheet are selected to provide resistance against the user when he or she presses their head into a sheet body of the elastomeric sheet. The frame has a plurality of frame members that define a first end, a second end, a first side and a second side of the frame that are in corresponding relation to the elastomeric sheet. The frame members further define a sheet support section and a shoulder engaging section. The sheet support section is sized and configured to support the elastomeric sheet in tension on the frame. The shoulder engaging section is structured and arranged to support the apparatus on at least one shoulder of the user with the head of the user positioned adjacent to the elastomeric sheet so the user can press their head into the elastomeric sheet when apparatus is supported on at least one of the user's shoulders to exercise the muscles of at least one of the user's neck, chin and face.

In the preferred configuration, the apparatus also has an adjusting mechanism that is attached to the elastomeric sheet and operatively supported by the frame. The adjusting mechanism is structured and arranged to allow the user to easily tighten or loosen the elastomeric sheet so as to increase or decrease the tension of the elastomeric sheet in order to, respectively, increase or decrease the resistance of the elastomeric sheet when the user presses his or her head into the elastomeric sheet when the apparatus is in use on at least one shoulder of the user. In one configuration, the adjusting mechanism comprises a roller bar that is rotatably supported by the sheet support section of the frame, with the first end of the elastomeric sheet being attached to the roller bar so as to increase the tension of the elastomeric sheet when the roller bar is rotated. Preferably, the apparatus also has a locking mechanism that is operatively associated with the adjusting mechanism and configured to lock the adjusting mechanism to prevent any further rotation of the roller bar until desired by the user. In one configuration, the adjusting mechanism has one or more roller mounts that rotatably support the roller bar and the locking mechanism has a locking member on a lock plate that is sized and configured to removably engage a plurality of locking apertures that are associated with one of the roller mounts. The locking member is cooperatively sized and configured with the locking apertures so as to be received in one of the locking apertures to lock the adjusting mechanism.

In a preferred configuration, the shoulder engaging section of the frame comprises a pair of rearward projecting members that are connected by a cross-member at a back side of the frame so as to define a generally U-shaped shoulder engaging section that is sized and configured to be placed on at least one shoulder of the user. Preferably, the apparatus also has a positioning guide that is attached to the frame, with the positioning guide comprising a guide member at a back side of the frame. The guide member has a lower end extending downward below the shoulder engaging section to assist with positioning the apparatus on at least one shoulder of the user. The guide member is sized and configured to extend below the user's shoulder and in front of or behind the shoulder(s) when the apparatus is in use with the apparatus on at least one shoulder of the user. The preferred embodiment of the apparatus also has a sheet engaging mechanism that is structured and arranged to engage the elastomeric sheet and attach the elastomeric sheet to the sheet support section of the frame. In one configuration, the sheet support section of the frame comprises a first upright member and a second upright member in spaced apart relation to the first upright member and the sheet engaging mechanism comprises one or more clamps that are associated with each of the first upright member and the second upright member, with each of the clamps configured to releasably engage the elastomeric sheet. To facilitate attachment of the elastomeric sheet, the elastomeric sheet can have at least one outwardly extending section at each of its first side and a second side, with the sheet engaging mechanism comprising one of the one or more clamps for each of the outwardly extending sections to engage the outwardly extending section and removably attach the elastomeric sheet to the sheet support section. Alternatively, the sheet support section of the frame comprises one or more frame tabs and the elastomeric sheet has a sheet aperture in corresponding relation to each of the frame tabs and a connecting device being utilized to secure the elastomeric sheet to the frame tabs through the sheet apertures.

Accordingly, the primary object of the present invention is to provide a new toning and strengthening apparatus for the neck, chin and face having the various advantages which are set forth above and which overcomes the various disadvantages and limitations associated with presently available apparatuses for toning and strengthening these areas of a person's body.

It is an important object of the present invention to provide a new toning and strengthening apparatus that is structured and arranged to tone and strengthen the muscles of a person's neck, chin and face to reduce pain and other problems which are associated with a lack of muscle strength in these areas of his or her body.

It is also an important object of the present invention to provide a new apparatus for toning and strengthening the muscles of a person's neck, chin and face that is safe, easy and convenient to use, does not require specialized knowledge or training and does not need electrical or other power to use.

An important aspect of the present invention is that it provides a new apparatus for toning and strengthening the muscles of a person's neck, chin and face which accomplishes the objectives set forth above and elsewhere in the present disclosure.

Another important aspect of the present invention is that it provides a new toning and strengthening apparatus which is structured and arranged to tone and strengthen the muscles at or around a person's neck, chin and face in order to reduce pain and to address other problems that are associated with a lack of muscle strength in these areas of his or her body.

Another important aspect of the present invention is that it provides a new toning and strengthening apparatus which is safe and easy for a person to use and is relatively lightweight, compact and portable, allowing the apparatus to be utilized in any convenient location and the user to travel with the apparatus as may be desired or necessary.

Another important aspect of the present invention is that it provides a new toning and strengthening apparatus which does not require any specialized knowledge or training to benefit from its use and does not need electrical or other power sources in order be utilized for its intended purpose.

Another important aspect of the present invention is that it provides a new toning and strengthening apparatus which is structured and arranged to tone and strengthen the muscles at or around a person's neck, chin and face that has a frame which is configured to be supported on one or more of the user's shoulders and which, preferably, adjustably supports an elastomeric sheet against which the user moves his head to provide a resistance force that tones and strengthens the muscles of his or her neck, chin and face.

Yet another important aspect of the present invention is that it provides a new toning and strengthening apparatus for the muscles of a person's neck, chin and face which is relatively inexpensive to manufacture so that the new apparatus may be widely utilized by persons who are wanting to tone and strengthen these areas of his or her body.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction and mode of operation presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
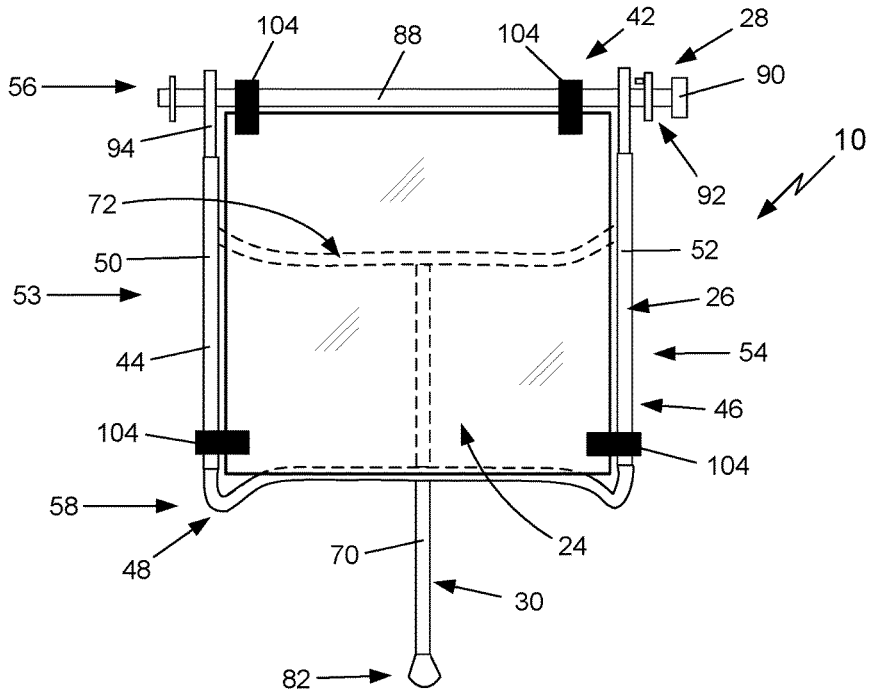
FIG. 1 is a front view of a toning and strengthening apparatus that is configured according to a preferred embodiment of the present invention.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular configurations for the toning and strengthening apparatus of the present invention, as well as how the present invention may be are utilized, persons who are skilled in the relevant art will readily appreciate that the present invention and how the present invention may be utilized are not so limited. For instance, the frame and elastomeric sheet of the new apparatus may be configured different than described or shown, such as having different types, sizes and shapes of frame members, sheet adjustment mechanisms and elastic materials. In addition, the exemplary embodiments of the present apparatus are shown and described with only those components which are required to disclose the present invention. As such, many of the necessary components for manufacturing and using the present invention are not shown in the drawings or necessarily described below, but which are well known to persons skilled in the relevant art. As will be readily appreciated by such persons, the various elements of the present invention that are described below may take on any form consistent with forms which are readily realized by one of ordinary skill in the art having knowledge of frames that adjustably support an elastomeric sheet.

A new toning and strengthening apparatus that is configured pursuant to one of the preferred embodiments of the present invention is shown generally as 10 in FIGS. 1-4 and 11-21. As shown in these figures and set forth in more detail below, the apparatus 10 of the present invention is structured and arranged to be utilized by a person (the user) 12 to tone and strengthen the muscles in and around his or her neck 14, chin 16 and face 18 by pressing and moving his or her head 20 against the apparatus 10 while the apparatus 10 rests on or against his or her shoulders 22, as shown in FIGS. 11-21. The apparatus 10 generally comprises an elastomeric sheet 24 that is supported by a frame 26 which, when in use, rests on the shoulders 22 of the user 12 so he or she may press their head 20 against the elastomeric sheet 24 in a manner which will exercise the muscles in his or her neck 14, chin 16 and face 18 to tone and strengthen those muscles. As set forth in more detail below, the user 12 places the frame 26 on his or her shoulders 22 in a manner in which the elastomer sheet 24 is at least substantially adjacent his or her head 20 and then presses his or her head against the elastomeric sheet 24 so the resistance force provided by the elasticity of the elastomeric sheet 24 will exercise the muscles of the neck 14, chin 16 and face 18. In a preferred embodiment, the user 12 can adjust the amount of resistance provided by the elastomeric sheet 24 using an adjusting mechanism 28 supported by the frame 26 and the elastomeric sheet 24 can be replaced to use an elastomeric sheet 24 with more or less resistance and if the elastomeric sheet 24 gets dirty or damaged. The preferred embodiment also utilizes a positioning guide 30 to help position the frame 26 on the shoulders 22 of the user 12 during use of the apparatus 10 by the user 12 to tone and strengthen the muscles of his or her neck 14, chin 16 and face 18.

Figure 4:
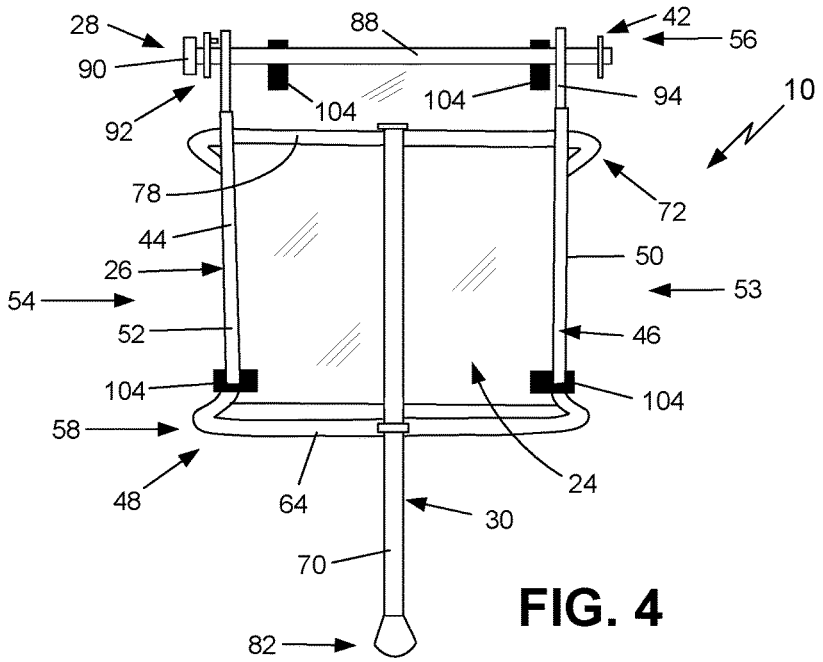
FIG. 4 is a back view of the apparatus of FIG. 1.
Figure 5:
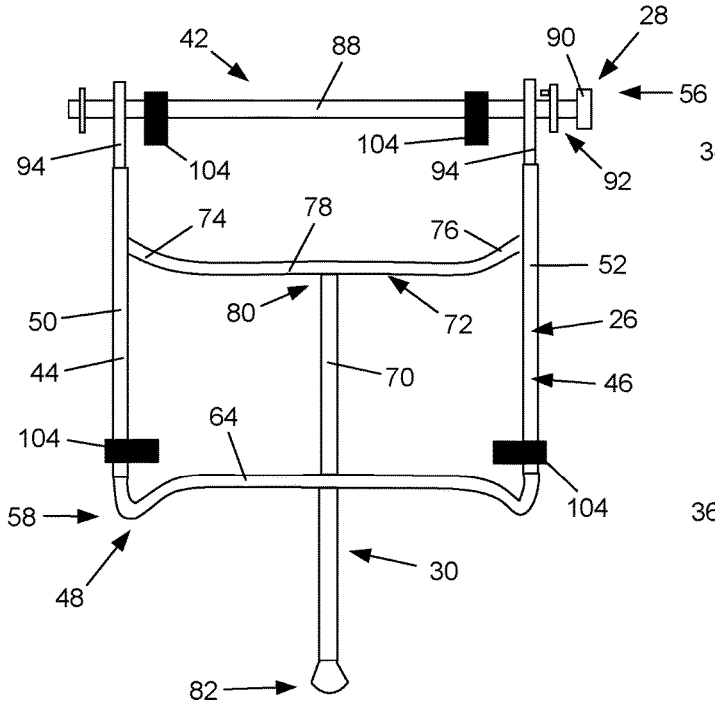
FIG. 5 is a front view of the apparatus of FIG. 1 shown without the elastomeric sheet.

For purposes of describing the relative location of the components and the use of the apparatus 10 of the present invention, the terms "front", "forward", "forwardly" and the like are utilized to refer to the direction of the side of the apparatus 10 having the elastomeric sheet 24 against which the user 12 presses his or her head 20, which side is facing toward the reader in FIG. 1 and the terms "back", "rearward", "rearwardly" and the like are utilized to refer to the opposite side of the apparatus 10, which is the direction of the apparatus 10 that is facing toward the reader in FIG. 4. The terms "upward", "upwardly", "upper", "top" and the terms "downward", "downwardly", "lower", "bottom" and the like refer to the direction of the ends of the apparatus 10 and the various components thereof that correspond, respectively, to the top of the user's head 20 and the bottom of the user's head 20 and the area around his or her shoulders 22.

The elastomeric sheet 24 is cooperatively sized and configured to be supported by the frame 26 such that the sheet body 32 of the elastomeric sheet 24 will contact the user's head 20 during his or her use of the new apparatus 10, as shown in FIGS. 11-21. More specifically, the elastomeric sheet 24 is securely held in place by the frame 26, as shown in FIGS. 1-4, such that when the user 12 presses his or her head 20 against the sheet body 32 of the elastomeric sheet 24, the elastomeric sheet 24 will provide sufficient resistance to the force applied by the user 12 that the resistance will exercise the muscles of at least one of his or her neck 14, chin 16 and face 18. In some uses, the user 12 will press the front of the face 18, back of the head 20 or one of the sides of the head 20 against the sheet body 32 of the elastomeric sheet 24 when he or she is using the apparatus 10 to tone and strengthen the muscles of his or her neck 14, chin 16 or face 18. In light of the above, at least the sheet body 32 of the elastomeric sheet 24 should be made out of a material that is sufficiently elastic that it will provide resistance to the force applied by the user 12 and then respond back to its original size and shape when the force is removed. In one embodiment, at least the sheet body 32 of the elastomeric sheet 24 is made from rubber or a rubber-like material that is selected to provide the desired amount of resistance to the force applied by the user. In addition, the material for the sheet body 32 should be selected to be comfortable for the user to press his or her head 20, particularly the face 18, against during use of the apparatus 10. In one configuration, a non-latex rubber is utilized for the elastomeric sheet 24. In other embodiments, certain thermoplastic elastomers or other copolymers, and perhaps other materials, will have sufficient elasticity to provide the properties that are desired for the sheet body 32 of the elastomeric sheet 24 of the apparatus 10 of the present invention. If desired, elastomeric sheet 24 can be perforated or formed from an elastic netting material for the comfort, such as preventing overheating, of the user 12 when he or she is using apparatus 10 to tone and strengthen his or her neck 14, chin 16 and face 18.

Figure 6:
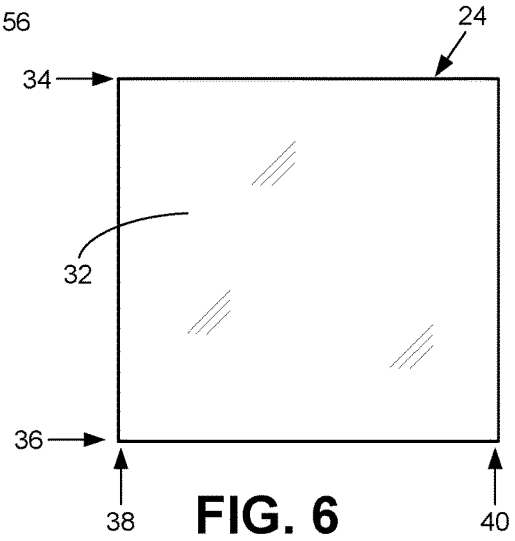
FIG. 6 is a front view of the elastomeric sheet of the apparatus of FIG. 1.

In one embodiment, the elastomeric sheet 24 is made up entirely of the elastic sheet body 32, such that the sheet body 32 extends between the first or upper end 34 and the second or lower end 36 and between the first or left side 38 and the second or right side 40 of the elastomeric sheet 24, as best shown in FIG. 6. As set forth in more detail below, in a preferred embodiment, a sheet securing mechanism 42 is utilized to secure both of the ends 34/36 and sides 38/40 of the elastomeric sheet 24 to the frame 26. In the embodiment described above where the sheet body 32 corresponds to the entire size of the elastomeric sheet 24, the sheet securing mechanism 42 engages the ends and sides of the sheet body 32. In other embodiments, not shown, the elastomeric sheet 24 has a border on one or more of its ends 34/36 and sides 38/40 that are sized and configured to assist with securing the elastomeric sheet 24 to the frame 26. In these embodiments, the sheet securing mechanism 42 can engagedly connect to the border around the sheet body 32 to secure the elastomeric sheet 24 to the frame 26. Persons who are skilled in the art will readily appreciate and understand the configuration and use of a border around the sheet body 32 and the use of the border to engage with the sheet engaging mechanism 42.

As set forth above, the frame 26 is structured and arranged to support the elastomeric sheet 24 and to allow the apparatus 10 to be supported on the shoulders 22 of the user 12 when he or she is using the apparatus 10 to exercise the muscles in his or her neck 14, chin 16 and face 18 to tone and strengthen those muscles. As best shown in FIGS. 1-5, the frame 26 comprises a plurality of frame members 44 that are structured and arranged in a forwardly positioned sheet support section 46 that supports the elastomeric sheet 24 in its upright position for engagement by the user's head 20 during use of apparatus 10 and a downwardly positioned shoulder engaging section 48 which engages, so as to be supported on, the shoulders 22 of the user 12 during use of apparatus 10.

The frame members 44 of the sheet support section 46 comprise a first upright member 50 and a second upright member 52 that are in spaced apart relation to each other an amount to stretch the elastomeric sheet 24 therebetween when engaged by the sheet engaging mechanism 42, as shown in FIGS. 1-4. The first upright members 50 are positioned on the first or left side 53 of the frame 26 and the second upright members 52 are positioned on the second or right side 54 of the frame 26 and they extend between a first or upper end 56 and a second or lower end 58 of the frame 26, as best shown in FIGS. 1-4. When the elastomeric sheet 24 is stretched between and attached to the frame 26, the first/upper end 34 and second/lower end 36 of the elastomeric sheet 24 will generally correspond, respectively, with the positions of the first/upper end 56 and second/lower end 58 of the frame 26 and, likewise, the first/left side 38 and second/right side 40 of the elastomeric sheet 24 will generally correspond, respectively, with the first/left side 53 and second/right side 54 of the frame 24, as best shown with regard to FIGS. 1, 5 and 6. The sheet support section 46, as well as the elastomeric sheet 24 itself, are sized and shaped such that when the shoulder engaging section 48 of the apparatus 10 is resting on the shoulders 22 of user 12, the only contact between the user's head 20 and the apparatus 10 will be the sheet body 32 of elastomeric sheet 24, such that the user's head 20 will not contact the frame members 44 of the sheet support section 46 or any other frame member 44 of frame 26.

Figure 2:
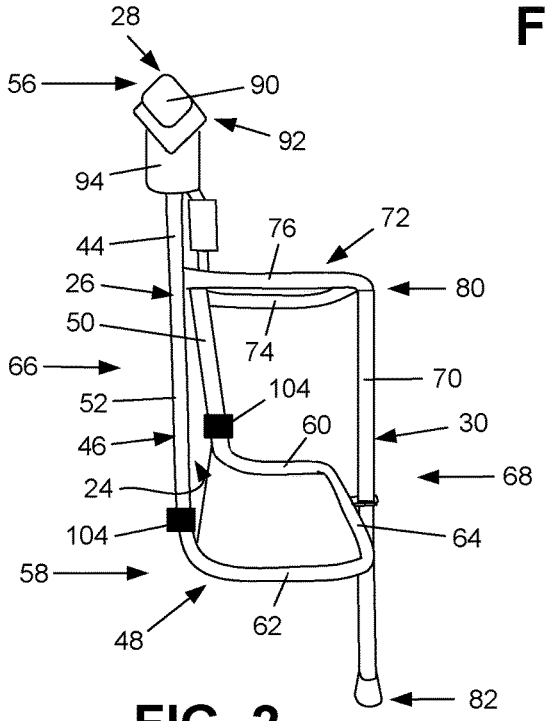
FIG. 2 is a right side view of the apparatus of FIG. 1.
Figure 3:
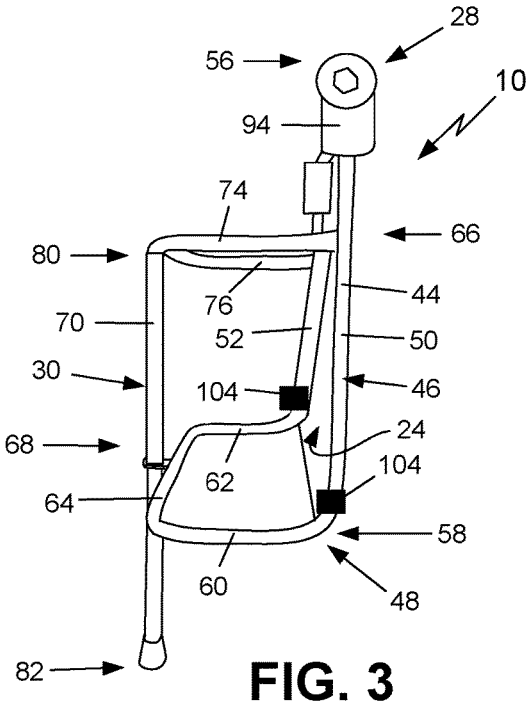
FIG. 3 is a left side view of the apparatus of FIG. 1.

As set forth above, the frame members 44 of the shoulder engaging section 48 are structured and arranged to allow the frame 26 of the apparatus 10 to be supported on the shoulders 22 of the user 12 during use of the apparatus 10. In the embodiment shown in the figures, the shoulder engaging section 48 comprises a pair of spaced apart rearward projecting members 60 and 62 on, respectively, the first/left side 53 and the second/right side 54 of the frame 26 and a rearwardly disposed cross-member 64 that connects the two rearward projecting members 60/62 rearward of the sheet support section 46. As best shown in FIGS. 2-3, the upright members 50/52 of the sheet support section 46 are at a front side 66 of the frame 26 and the cross-member 64 of the shoulder engaging section 48 is at a back side 68 of the frame 26. In the embodiment shown in the figures, shoulder engaging section 48 has a generally U-shaped configuration at the second/lower end 58 of the frame 26 to allow at least one of rearward projecting members 60/62 and cross-member 64 to rest on one or more of the shoulders 22 of the user 12 during use of apparatus 10. As will be readily appreciated by persons who are skilled in the relevant art, the one or more of the rearward projecting members 60/62 and the cross-member 64 can be fully or partially coated or covered with a material that will comfortably contact the shoulder(s) 22 of the user 12 during use of the apparatus 10.

The positioning guide 30 of apparatus 10 is structured and arranged to help the user 12 position the apparatus 10 on his or her shoulders 22 and to hold that position while the user 12 presses his or her head 20 against the elastomeric sheet 24 while toning and strengthening the muscles in his or her neck 14, chin 16 and face 18. In the embodiment shown in the figures, the positioning guide 30 of apparatus 10 comprises a guide member 70 that is positioned at or near the back side 68 of the apparatus 10 and attached to or integral with the cross-member 64 of the shoulder engaging section 48, as best shown in FIGS. 1-5. To support the guide member 70, the frame 26 also has a guide support section 72 that is located generally between the first/upper end 56 of the frame 26 (where the adjusting mechanism 28 is located) and the second/lower end 58 of the frame 26 (where the shoulder engaging section 48 is located). In the embodiment shown in the figures, the guide support section 72 is configured substantially the same as the shoulder engaging section 48 with a pair of rearward projecting members 74/76 and a rearwardly disposed cross-member 78 that, collectively, are formed in a generally U-shaped configuration, as best shown in FIGS. 1-5. As shown in these figures, the upper end 80 of the guide member 70 is attached to or integral with the cross-member 78 of the guide support section 72 and the lower end 82 of the guide member 70 extends below the second/lower end 58 of the frame 26. In one configuration, the lower end 82 will be approximately ten to eighteen inches below the second/lower end (e.g., where the shoulder engaging section 48 is located) of the frame 26. Together, the two cross-members 64/78 securely hold the guide member 70 in a rigid vertical configuration so the guide member 70 can be pressed against the area of the user's shoulders 22 or chest 84 or against the user's back 86, as shown in FIGS. 11-21. During use, the user 12 will grasp onto either the guide member 70, guide support section 72 or other areas of the frame 26 to help hold the frame 26 on the user's shoulders 22 as he or she presses his or her head 20 against the elastomeric sheet 24. As will be readily appreciated by persons who are skilled in the relevant art, in order for the elastomeric sheet 24 to provide the resistance necessary to exercise the user's neck 14, chin 16 and head 20, the apparatus 10 must be held in place on the user's shoulders 22. The positioning guide 30 described above will allow this to take effect. If desired, the apparatus 10 may have two or more guide members 70 for the positioning guide 30.

In one embodiment, the elastomeric sheet 24 can be fixedly attached to the sheet support section 46 of the frame 26 in a manner that the elastomeric sheet 24 does not move relative to the sheet support section 46, except for the sheet body 32 to move rearward in response to the user pressing his or her head 20 against the sheet body 32. However, as set forth above, in a preferred embodiment of the present invention, the apparatus 10 comprises an adjusting mechanism 42 that is structured and arranged to allow the user 12 to provide more or less tension on the elastomeric sheet 24 to increase or decrease the amount of resistance provided by the elastomeric sheet 24 to the user pressing his or her head 20 against the sheet body 32. In one embodiment, the adjusting mechanism 42 comprises a roller bar 88 that rotates relative to the frame 26, a handle 90 that is attached to the roller bar 88 to rotate the roller bar 88 and a locking mechanism 92 associated with the roller bar 88 to lock the roller bar 88 in a particular position in a manner which prevents any unintentional rotation of the roller bar 88, as best shown in FIGS. 1-5 and 7-8. At the first/upper end 56 of the frame 26 are a pair of roller mounts 94 that rotatably support the roller bar 88. In one embodiment, the roller bar 88 is round and each of the roller mounts 94 have bar apertures 96 that are sized and configured to allow the roller bar 88 to pass therethrough and to rotate relative thereto, as shown in FIGS. 1-5 and 7-8. The handle 90, which in the figures is the knob at the first/upper end 56 and outward of the second/right side 54 of the frame 26, is sized and configured to allow the user 12 to grasp onto and rotate the roller bar 88 to apply the desired amount of tension to the elastomeric sheet 24. The locking mechanism 92 locks the roller bar 88 so it can no longer, until acted upon by the user 12, rotate relative to the roller mounts 94. The two roller mounts 94 can be separate components that are fixedly attached to the first/upper end 56 of the frame 26, as shown in the figures, or they can be integrally formed with the frame 26.

Figure 7:
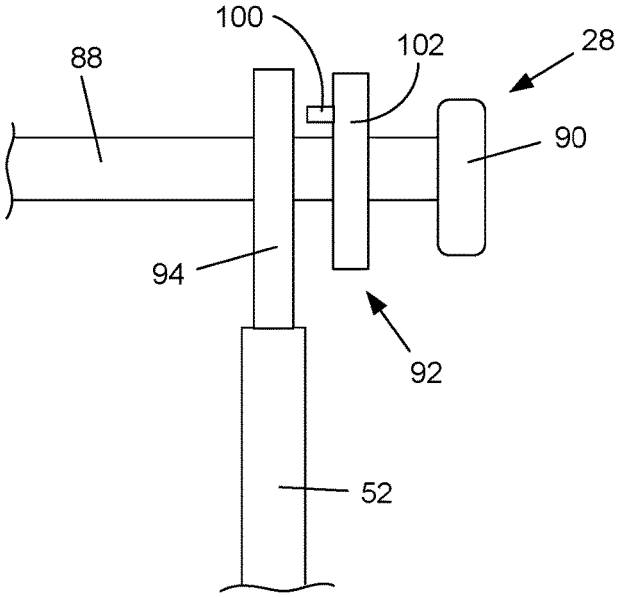
FIG. 7 is an isolated front view of upper right side of the apparatus of FIG. 5 particularly showing part of the adjustment mechanism of the apparatus.
Figure 8:
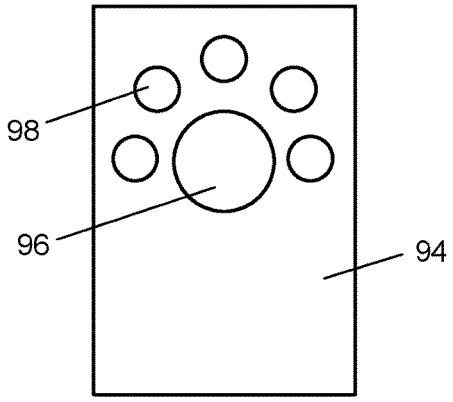
FIG. 8 is an enlarged right side view of the roller mount of the adjusting mechanism of FIG. 7.

For locking mechanism 92 of the embodiment shown in the figures, the roller mount 94 associated with handle 90, best shown in FIG. 6, has a plurality of locking apertures 98, that are positioned around the bar aperture 96 (as best shown in FIG. 7) and which are each sized and configured to removably receive a locking member 100 that extends inwardly toward the locking apertures 98 on the roller mount 94 from a locking plate 102 that is fixedly attached to the roller bar 88. As will be readily understood by persons who are skilled in the art, the locking member 100 is placed in one of the locking apertures 98 to prevent rotation of the roller bar 88 and lock in a particular tension on the elastomeric sheet 24. When the user 12 wants to increase or decrease the amount of tension, he or she will pull outward on the handle 90 to pull the locking member 100 out of its locking aperture 98 (e.g., disengage the locking mechanism 92), use the handle 90 to rotate the roller bar 88 and the lock plate 102 attached thereto until the locking member 100 is at a different locking aperture 98 that provides the desired tension for the elastomeric sheet 24, and then push the handle 90 inward to push the locking member 100 into the desired locking aperture 98 (e.g., to engage the locking mechanism 92) to lock the locking mechanism 92 and prevent unintentional rotation of the roller bar 88 and any undesired loosening or tightening of elastomeric sheet 24 by the adjusting mechanism 28. If desired, the locking mechanism 92 of the adjusting mechanism 28 may be associated with the roller mount 94 at the first/left side 53 of the frame 26 (e.g., opposite side than described above), which will result in the user 12 pushing the handle 90 inward to disengage the locking mechanism 92 to change the tension of the adjusting mechanism 28 and pulling the handle 90 outward to engage the locking mechanism 92 to prevent rotation of the roller bar 88 and further increase or decrease the tension applied to the elastomeric sheet 24. A variety of other types and configurations of locking mechanisms 92 can be utilized with the apparatus 10 of the present invention to allow the user 12 to selectively and incrementally apply more or less tension to the elastomeric sheet 24 to result in increased or decreased resistance to the user 12 pressing his or her head 20 against the elastomeric sheet 24 during use of the apparatus 10 of the present invention.

As set forth above, the elastomeric sheet 24 is held in place on the sheet support section 46 of the frame 26 of apparatus 10 by a sheet engaging mechanism 42 that is structured and arranged in corresponding relation to the elastomeric sheet 24 so that the elastomeric sheet 24 will be held in place on the frame 26 when the user 12 is using apparatus 10 to tone and strengthen his neck 14, chin 16 and face 18. Although the elastomeric sheet 24 and sheet engaging mechanism 42 can be configured for the elastomeric sheet 24 to be fixedly attached to the frame 26, in the preferred embodiments of the present invention, the elastomeric sheet 24 is removably held in place on the frame 26 by the sheet engaging mechanism 42. In the embodiment shown in FIGS. 1-6, the elastomeric sheet 24 is a generally square or rectangular shape and is held in place by a plurality of clamps 104, functioning as sheet engaging mechanism 42, that are associated with the frame 26 to removably engage the elastomeric sheet 24. More specifically, the clamps 104 are attached to the sheet support section 46 of the frame 42 with the clamping portion of each of the clamps 104 extending inward (e.g., toward elastomeric sheet 24) so as to clamp onto areas of the sheet body 32 of the elastomeric sheet 24. As best shown in FIGS. 1 and 4, the clamps 104 can clamp onto elastomeric sheet 24 at or near its first/upper end 34 and sides 38/40. If the elastomeric sheet 24 has a border or frame associated with (at least at the relevant areas) the sheet body 32, then the clamping portion of the clamps 104 can removably clamp onto the border or frame.

Figure 9:
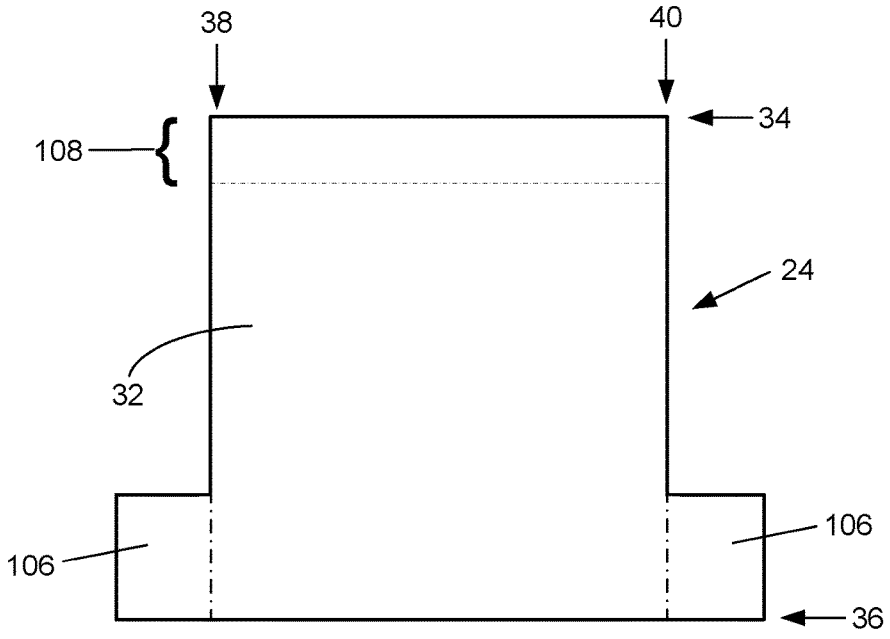
FIG. 9 is a front view of an alternative configuration for the elastomeric sheet showing use of an upper area and outwardly extending sections.
Figure 10:
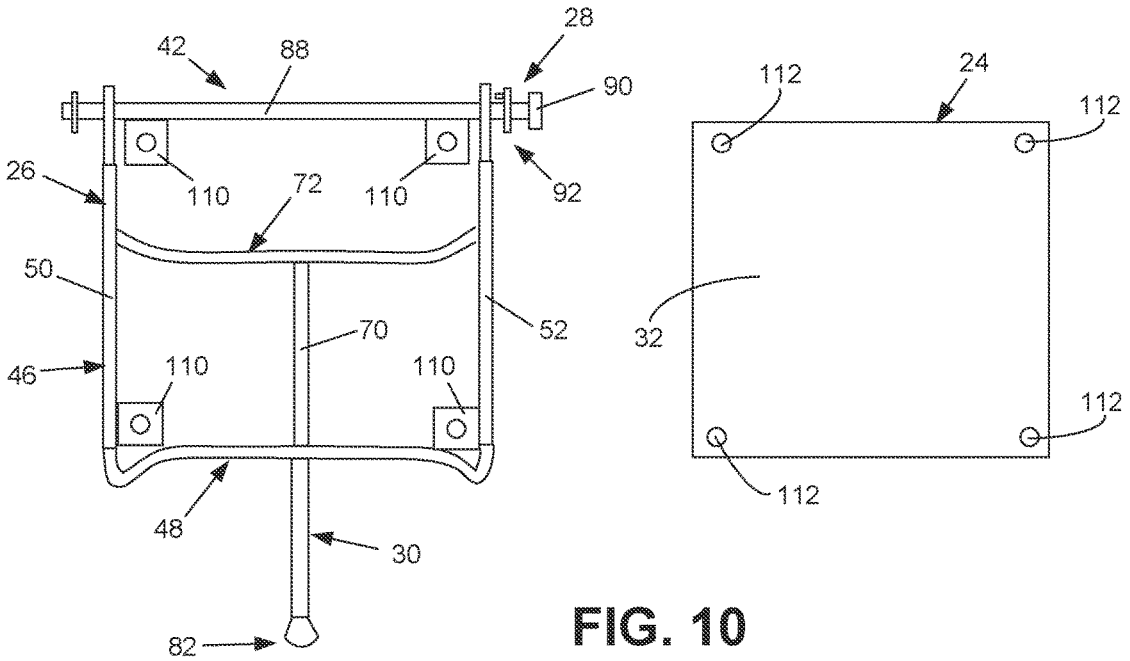
FIG. 10 is a front view of a frame, with the positioning mechanism attached thereto, and an elastomeric sheet showing an alternative configuration for the sheet engaging mechanism for the apparatus of the present invention.

In an alternative embodiment, the elastomeric sheet 24 can be configured such that it has outwardly extending sections 106 at the sides 38/40 of the elastomeric sheet 24 and the first/upper end 34 has an upper area 108 which extends upward from first/upper end 34, as shown in FIG. 9. In this embodiment, the outwardly extending sections 106 and the upper area 108 wrap or fold around, respectively, the upright members 50/52 and the roller bar 88 for a clamp 104 (preferably of the tubular type) to clamp the outwardly extending sections 106 to their respective upright members 50/52 and the upper area 108 to the roller bar 88. In another embodiment, shown in FIG. 10, the sheet engaging mechanism 42 has one or more frame tabs 110 that are associated with the roller bar 88 (two shown in FIG. 10) and at least one frame tab 110 associated with each upright member 50/52 and the elastomeric sheet 24 has corresponding sheet apertures 112 that allow a connecting device, such as a screw, bolt, ties, snaps or the like, to connect (removably) each sheet aperture 112 to its corresponding frame tab 110 to secure the elastomeric sheet 24 to the sheet support section 48 of the frame 26. In a likely preferred configuration of this embodiment, the area around sheet apertures 112 will be reinforced to reduce the likelihood of tearing or ripping the elastomeric sheet 24. As will be readily appreciated by persons who are skilled in the relevant art, a variety of other configurations and devices can be utilized as the sheet engaging mechanism 42 to fixedly or, preferably, removably secure the elastomeric sheet 24 to the frame 26.

The frame members 44 of frame 26 of apparatus 10 are sufficiently strong and rigid to accomplish the objectives of the present invention with regard to the user 12 pressing his or her head 20 against the elastomeric sheet 24 during use of the apparatus 10. Frame members 44 can be made out of a wide variety of different materials, including metal, plastic, wood, hard rubber, composite and the like. Preferably, the material or materials for the frame members 44 are selected to be strong but lightweight so the frame 26 will be relatively lightweight and, therefore, easy to handle and not too heavy when placed on the user's shoulders 22. In one embodiment, the frame members 44 are a rolled or extruded tubular shaped metal, such as steel, stainless steel, aluminum or the like, or a rolled or extruded plastic (also tubular). In one configuration, the frame members 44 are half inch diameter material. As will be readily appreciated by persons who are skilled in the relevant art, the frame members 44 are not limited to any particular size or material.

In one embodiment, the frame members 44 are connected to each other or integrally formed such that the apparatus 10 has a fixed dimension. If desired, however, the frame 26 can be configured to be able to collapse so it will be easier for the user 12 to store and move the apparatus 10. In one configuration, one or more of the frame members 44 of the frame 26, guide member 70 and roller bar 88 can be telescopically configured so the frame 26, positioning guide 30 and adjusting mechanism 28 can collapse the apparatus 10 down to its smallest size possible. In addition, if desired, various components can be pivotally connected to further assist the user 12 in collapsing the apparatus 10. In either of these configurations, the telescopically configured and/or pivotally connected frame members 44 will need to lock when the apparatus 10 is set-up for use to avoid injury to the user 12 or damage to the apparatus 10.

Figure 11:
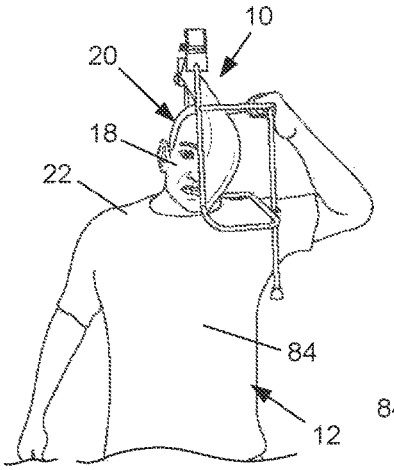
FIG. 11 is a front view of a user and a right side view of the apparatus of FIG. 1 showing the user utilizing the apparatus with the apparatus shown positioned on the user's left shoulder.
Figure 12:
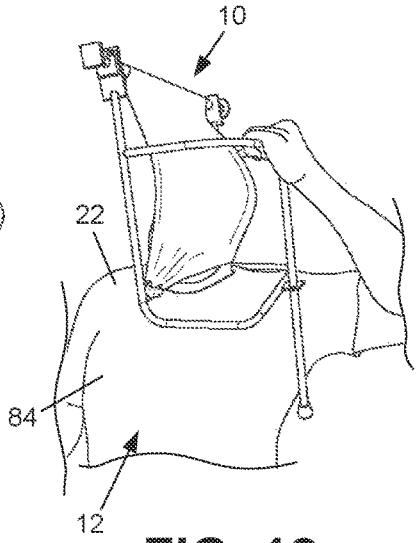
FIG. 12 is a right side perspective view of the user and apparatus of FIG. 11.
Figure 13:
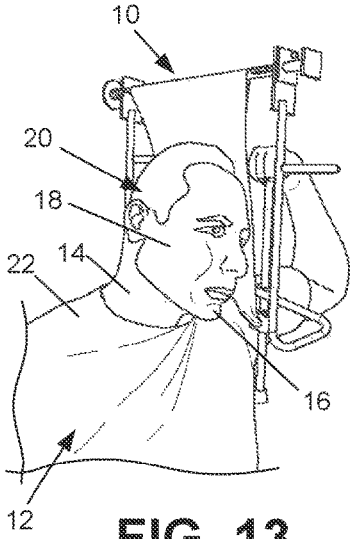
FIG. 13 is a left side perspective view of the user and apparatus of FIG. 11.
Figure 14:
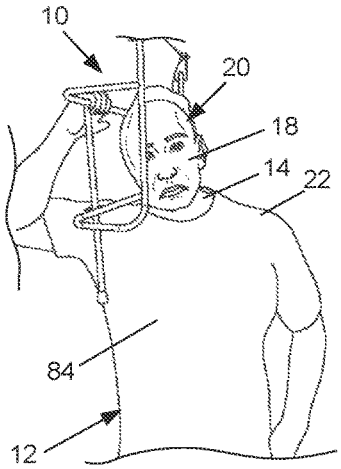
FIG. 14 is a front view of a user and a left side view of the apparatus of FIG. 1 showing the user utilizing the apparatus with the apparatus shown positioned on the user's right shoulder.
Figure 15:
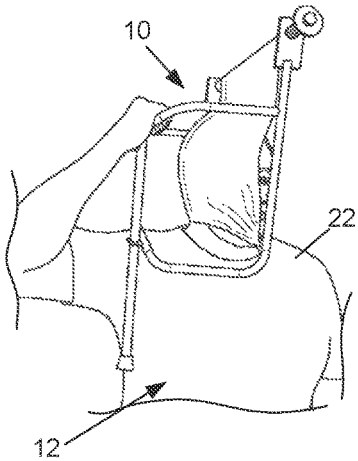
FIG. 15 is a right side perspective view of the user and apparatus of FIG. 14.
Figure 16:
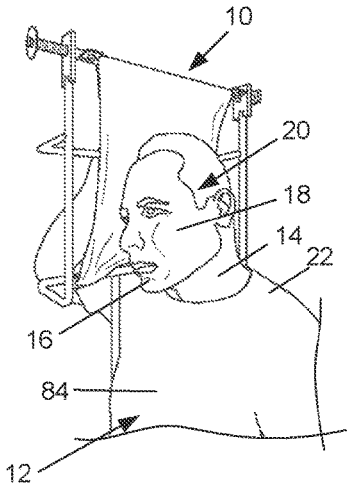
FIG. 16 is a right side perspective view of the user and apparatus of FIG. 14.
Figure 17:
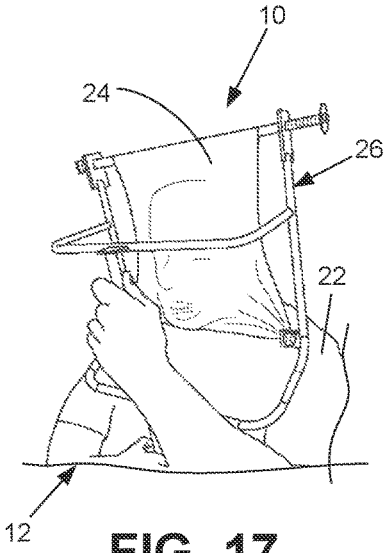
FIG. 17 is a right side perspective view of a user and a back perspective view of the apparatus of FIG. 1 showing the user utilizing the apparatus with the apparatus shown positioned on both shoulders and across the chest while the user is leaning forward into the elastomeric sheet.
Figure 18:
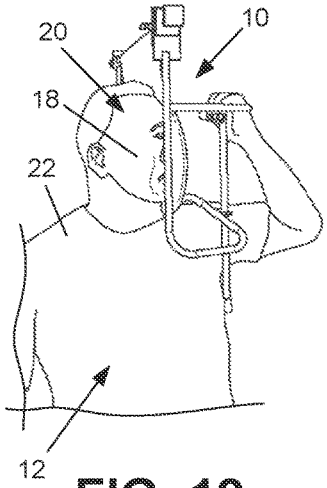
FIG. 18 is a left side perspective view of a user and a front perspective view of the apparatus of FIG. 1 showing the user turning their head into the elastomeric sheet.
Figure 19:
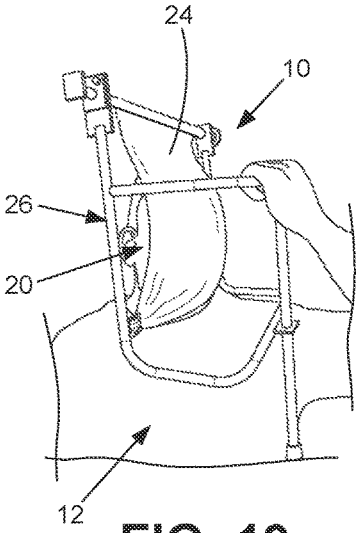
FIG. 19 is right side perspective view of the user and a right side perspective view of the apparatus of FIG. 18.
Figure 20:
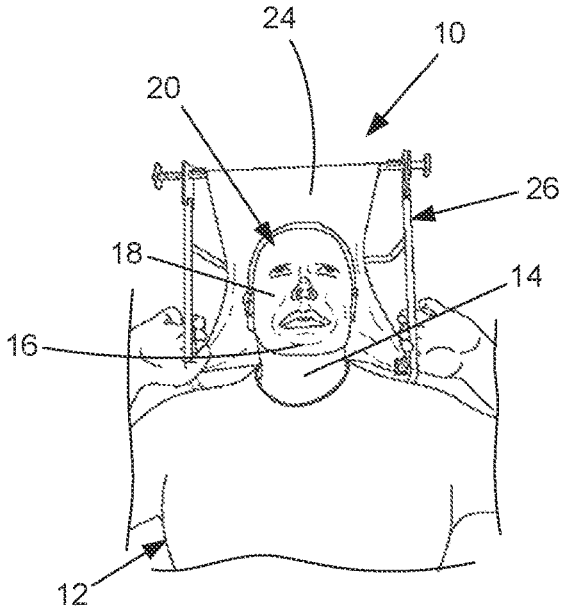
FIG. 20 is a front view of a user and the apparatus of FIG. 1 showing the apparatus on the user's shoulders and across the user's back while leaning backward into the elastomeric sheet.
Figure 21:
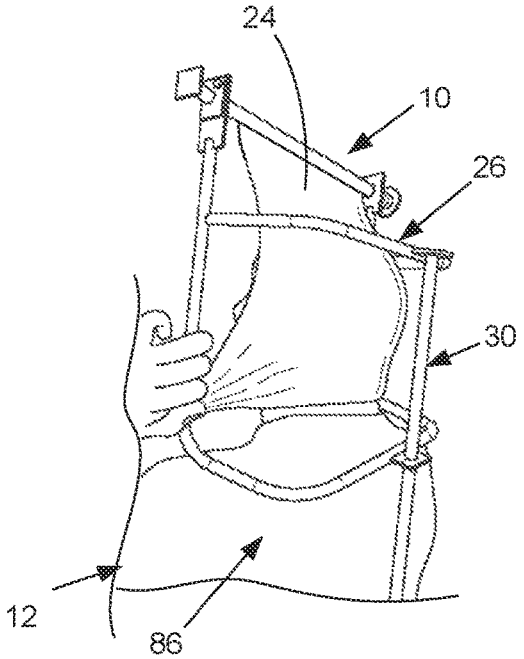
FIG. 21 is a right side perspective view of the user and apparatus of FIG. 20.

Use of the present invention is shown in FIGS. 11-21. In FIGS. 11-13, the user 12 has the shoulder engaging section 48 of the apparatus 10 resting on their left shoulder 22 and they are leaning their head 20 into the elastomeric sheet 24. In FIGS. 14-16, the shoulder engaging section 48 of apparatus 10 is resting on the user's right shoulder 22 and they are leaning their head 20 into the elastomeric sheet 24. In FIG. 17, the shoulder engaging section 48 of the apparatus 10 is on the user's shoulders 22 and across the user's chest 84 and they are leaning their face 18 forward into elastomeric sheet 14. In FIGS. 18-19, the shoulder engaging section 48 of the apparatus 10 is on the user's left shoulder 22 and the user 12 is rotating their head 20 to the left to progressively encounter resistance from the elastomeric sheet 24. In FIGS. 20-21, the user 12 has the shoulder engaging section 48 of the apparatus 10 on their shoulders 22 and across their back 86 and the user 12 is leaning their head 20 rearward against the elastomeric sheet 24. In each of these example uses, the user 12 is exercising the muscles of the neck 14, chin 16 and face 18 to both tone and strengthen these muscles. The user 12 can benefit from use of the apparatus 10 by, as may be recommended by a physical therapist or the like, performing multiple repetitions in the different presses set forth above on a daily or nearly daily basis.

As will be readily appreciated by persons who are skilled in the relevant art, the apparatus 10 of the present invention has numerous advantages over devices and apparatuses in the prior art. For instance, the new apparatus 10 does not require the user 12 to stabilize the apparatus 10 on the ground or to attach the apparatus 10 to a wall, chair or other object in order to utilize the apparatus 10. The apparatus 10 provides for measured resistance adjustment and for replacement of the elastomeric sheet 24 as needed or desired. The apparatus 10 has very few moving parts and does not need the use of any external devices, such as collars, head braces, masks, helmets or the like, to be used. The new apparatus 10 is easily fitted to a user 12 and it allows the user 12 to change positions without having to make changes to the apparatus 10. In addition, the new apparatus 10 does not require electricity or any other source of power or external weighting to function. The apparatus 10 allows the user 12 to quickly and easily increase or decrease the tension of the elastomeric sheet 24 and to control the amount of pressure on his or her neck 14, chin 16 or face 18 by controlling how hard he or she presses against the elastomeric sheet 24. The positioning guide 30 is utilized for placing and holding the apparatus 10 in position when using the new apparatus 10 and, if desired, the apparatus 10 can be utilized as the sole device for neck 14, chin 16 and face 18 toning and strengthening.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. An apparatus for toning and strengthening at least one of the neck, chin and face of a head of a user, said apparatus comprising:

an elastomeric sheet having a first end, a second end, a first side and a second side, said elastomeric sheet configured to provide resistance when the user presses their head into a sheet body of said elastomeric sheet;

a frame having a plurality of frame members defining a first end, a second end, a first side and a second side of said frame in corresponding relation to said elastomeric sheet, said frame members further defining a sheet support section and a shoulder engaging section, said sheet support section being sized and configured to support said elastomeric sheet in tension on said frame, said shoulder engaging section being structured and configured to support said apparatus on at least one shoulder of the user with the head of the user positioned adjacent to said elastomeric sheet so the user is capable of pressing their head into said elastomeric sheet when said shoulder engaging section is on the at least one shoulder of the user to exercise the muscles of at least one of the user's neck, the chin and the face;

an adjusting mechanism attached to said elastomeric sheet and operatively supported by said frame, said adjusting mechanism configured to tighten or loosen said elastomeric sheet so as to increase or decrease the tension of said elastomeric sheet to, respectively, increase or decrease the resistance of said elastomeric sheet when the user presses their head into said elastomeric sheet when said apparatus is on the at least one shoulder of the user, said adjusting mechanism having a roller bar rotatably supported by said sheet support section of said frame, said first end of said elastomeric sheet attached to said roller bar so as to increase the tension of said elastomeric sheet when said roller bar is rotated; and a locking mechanism associated with said adjusting mechanism to lock the adjusting mechanism and prevent further rotation of said roller bar, said adjusting mechanism having one or more roller mounts rotatably supporting said roller bar and said locking mechanism having a locking member on a lock plate that is sized and configured to removably engage a plurality of locking apertures associated with one of said one or more roller mounts, said locking member cooperatively sized and configured with said plurality of locking apertures so as to be received in said plurality of locking apertures.

2. The apparatus of claim 1 further comprising a sheet engaging mechanism structured and arranged to engage said elastomeric sheet and attach said elastomeric sheet to said sheet support section of said frame.

3. The apparatus of claim 2, wherein said sheet support section of said frame comprises a first upright member and a second upright member in spaced apart relation to said first upright member and said sheet engaging mechanism comprises one or more clamps associated with each of said first upright member and said second upright member, each of said one or more clamps configured to releasably engage said elastomeric sheet.

4. The apparatus of claim 3, wherein said elastomeric sheet has at least one outwardly extending section at each of said first side and said second side of said elastomeric sheet, said sheet engaging mechanism comprising one of said one or more clamps for each of said outwardly extending sections to engage said outwardly extending section and removably attach said elastomeric sheet to said sheet support section.

5. The apparatus of claim 2, wherein said sheet support section of said frame comprises one or more frame tabs and said elastomeric sheet has a sheet aperture in corresponding relation to each of said one or more frame tabs.

6. The apparatus of claim 1, wherein said shoulder engaging section of said frame comprises a pair of rearward projecting members connected by a cross-member at a back side of said frame so as to define a U-shaped shoulder engaging section configured to be placed on the at least one shoulder of the user.

7. The apparatus of claim 1 further comprising a positioning guide attached to said frame, said positioning guide comprising a guide member at a back side of said frame, said guide member having a lower end extending downward below said shoulder engaging section to assist with positioning said apparatus on the at least one shoulder of the user, said guide member being sized and configured to extend in front of or behind the at least one shoulder of the user when said apparatus is on the at least one shoulder of the user.

8. An apparatus for toning and strengthening at least one of the neck, chin and face of a head of a user, said apparatus comprising:

an elastomeric sheet having a first end, a second end, a first side and a second side, said elastomeric sheet configured to provide resistance when the user presses their head into a sheet body of said elastomeric sheet;

a frame having a plurality of frame members defining a first end, a second end, a first side and a second side of said frame in corresponding relation to said elastomeric sheet, said frame members further defining a sheet support section and a shoulder engaging section, said sheet support section being sized and configured to support said elastomeric sheet in tension on said frame, said shoulder engaging section having a pair of rearward projecting members that are connected by a cross-member at a back side of said frame so as to define a U-shaped shoulder engaging section configured to be placed on at least one shoulder of the user with the head of the user positioned adjacent to said elastomeric sheet so the user is capable of pressing their head into said elastomeric sheet when said shoulder engaging section is on the at least one shoulder of the user to exercise the muscles of at least one of the user's neck, the chin and the face;

an adjusting mechanism attached to said elastomeric sheet and operatively supported by said frame, said adjusting mechanism is configured to tighten or loosen said elastomeric sheet so as to increase or decrease the tension of said elastomeric sheet to, respectively, increase or decrease the resistance of said elastomeric sheet when the user presses their head into said elastomeric sheet when said apparatus is on the at least one shoulder of the user; and a positioning guide attached to said frame, said positioning guide comprising a guide member at a back side of said frame, said guide member having a lower end extending downward below said shoulder engaging section to assist with positioning said apparatus on the at least one shoulder of the user, said guide member being sized and configured to extend in front of or behind the at least one shoulder of the user when said apparatus is on the at least one shoulder of the user.

9. The apparatus of claim 8, wherein said adjusting mechanism comprises a roller bar rotatably supported by said sheet support section of said frame, said first end of said elastomeric sheet attached to said roller bar so as to increase the tension of said elastomeric sheet when said roller bar is rotated.

10. The apparatus of claim 9 further comprising a locking mechanism associated with said adjusting mechanism to lock the adjusting mechanism and prevent further rotation of said roller bar.

11. The apparatus of claim 10, wherein said adjusting mechanism has one or more roller mounts rotatably supporting said roller bar and said locking mechanism has a locking member on a lock plate that is sized and configured to removably engage a plurality of locking apertures associated with one of said one or more roller mounts, said locking member cooperatively sized and configured with said plurality of locking apertures so as to be received in said plurality of locking apertures.

12. The apparatus of claim 8, wherein said sheet support section of said frame comprises a first upright member and a second upright member in spaced apart relation to said first upright member and said sheet engaging mechanism comprises one or more clamps associated with each of said first upright member and said second upright member, each of said one or more clamps configured to releasably engage said elastomeric sheet.

13. An apparatus for toning and strengthening at least one of the neck, chin and face of a head of a user, said apparatus comprising:

an elastomeric sheet having a first end, a second end, a first side and a second side, said elastomeric sheet configured to provide resistance when the user presses their head into a sheet body of said elastomeric sheet;

a frame having a plurality of frame members defining a first end, a second end, a first side and a second side of said frame in corresponding relation to said elastomeric sheet, said frame members further defining a sheet support section and a shoulder engaging section, said sheet support section being sized and configured to support said elastomeric sheet in tension on said frame, said shoulder engaging section having a pair of rearward projecting members that are connected by a cross-member at a back side of said frame so as to define a U-shaped shoulder engaging section configured to be placed on at least one shoulder of the user with the head of the user positioned adjacent to said elastomeric sheet so the user is capable of pressing their head into said elastomeric sheet when said shoulder engaging section is on the at least one shoulder of the user to exercise the muscles of at least one of the user's neck, the chin and the face; and an adjusting mechanism attached to said elastomeric sheet and operatively supported by said frame, said adjusting mechanism having a roller bar rotatably supported by said sheet support section of said frame, said first end of said elastomeric sheet attached to said roller bar so as to tighten or loosen said elastomeric sheet when said roller bar is rotated to increase or decrease the tension of said elastomeric sheet to, respectively, increase or decrease the resistance of said elastomeric sheet when the user presses their head into said elastomeric sheet when said apparatus is on the at least one shoulder of the user;

a locking mechanism associated with said adjusting mechanism to lock the adjusting mechanism and prevent further rotation of said roller bar; and a positioning guide attached to said frame, said positioning guide comprising a guide member at a back side of said frame, said guide member having a lower end extending downward below said shoulder engaging section so as to assist with positioning said apparatus on the at least one shoulder of the user.

14. The apparatus of claim 13, wherein said adjusting mechanism has one or more roller mounts rotatably supporting said roller bar and said locking mechanism has a locking member on a lock plate that is sized and configured to removably engage a plurality of locking apertures associated with one of said one or more roller mounts, said locking member cooperatively sized and configured with said plurality of locking apertures so as to be received in said plurality of locking apertures.

15. The apparatus of claim 13, wherein said sheet support section of said frame comprises a first upright member and a second upright member in spaced apart relation to said first upright member and said sheet engaging mechanism comprises one or more clamps associated with each of said first upright member and said second upright member, each of said one or more clamps configured to releasably engage said elastomeric sheet.

16. An apparatus for toning and strengthening at least one of the neck, chin and face of a head of a user, said apparatus comprising:

an elastomeric sheet having a first end, a second end, a first side and a second side, said elastomeric sheet configured to provide resistance when the user presses their head into a sheet body of said elastomeric sheet;

a frame having a plurality of frame members defining a first end, a second end, a first side and a second side of said frame in corresponding relation to said elastomeric sheet, said frame members further defining a sheet support section and a shoulder engaging section, said sheet support section being sized and configured to support said elastomeric sheet in tension on said frame, said shoulder engaging section being structured and configured to support said apparatus on at least one shoulder of the user with the head of the user positioned adjacent to said elastomeric sheet so the user is capable of pressing their head into said elastomeric sheet when said shoulder engaging section is on the at least one shoulder of the user to exercise the muscles of at least one of the user's neck, the chin and the face; and a positioning guide attached to said frame, said positioning guide comprising a guide member at a back side of said frame, said guide member having a lower end extending downward below said shoulder engaging section to assist with positioning said apparatus on the at least one shoulder of the user, said guide member being sized and configured to extend in front of or behind the at least one shoulder of the user when said apparatus is on the at least one shoulder of the user.

17. The apparatus of claim 16 further comprising a sheet engaging mechanism structured and arranged to engage said elastomeric sheet and attach said elastomeric sheet to said sheet support section of said frame.

18. The apparatus of claim 17, wherein said sheet support section of said frame comprises a first upright member and a second upright member in spaced apart relation to said first upright member and said sheet engaging mechanism comprises one or more clamps associated with each of said first upright member and said second upright member, each of said one or more clamps configured to releasably engage said elastomeric sheet.

19. The apparatus of claim 18, wherein said elastomeric sheet has at least one outwardly extending section at each of said first side and said second side of said elastomeric sheet, said sheet engaging mechanism comprising one of said one or more clamps for each of said outwardly extending sections to engage said outwardly extending section and removably attach said elastomeric sheet to said sheet support section.

20. The apparatus of claim 16, wherein said shoulder engaging section of said frame comprises a pair of rearward projecting members connected by a cross-member at a back side of said frame so as to define a U-shaped shoulder engaging section configured to be placed on the at least one shoulder of the user.

* * * * *